US007817942B2

(12) United States Patent
Deguchi

(10) Patent No.: US 7,817,942 B2
(45) Date of Patent: Oct. 19, 2010

(54) IMAGE FORMING APPARATUS AND IMAGE FORMING METHOD WHICH UTILIZE A WET DEVELOPER SOLUTION

(75) Inventor: Masanobu Deguchi, Kashiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 96 days.

(21) Appl. No.: 12/118,067

(22) Filed: May 9, 2008

(65) Prior Publication Data

US 2008/0279590 A1 Nov. 13, 2008

(30) Foreign Application Priority Data

May 11, 2007 (JP) ..... P2007-127313

(51) Int. Cl.
*G03G 15/10* (2006.01)

(52) U.S. Cl. ..... 399/241; 399/248

(58) Field of Classification Search ..... 399/233–234, 399/237–244, 248

See application file for complete search history.

(56) References Cited

U.S. PATENT DOCUMENTS

| | | | | | |
|---|---|---|---|---|---|
| 3,776,723 | A | * | 12/1973 | Royka et al. | 430/102 |
| 3,862,618 | A | * | 1/1975 | Sato et al. | 399/247 |
| 4,278,343 | A | * | 7/1981 | Kurokawa | 399/241 |
| 5,122,815 | A | * | 6/1992 | Kondo | 346/74.2 |
| 5,216,201 | A | * | 6/1993 | Ohishi et al. | 399/102 |
| 5,247,334 | A | | 9/1993 | Miyakawa et al. | |
| 5,940,665 | A | * | 8/1999 | Domoto et al. | 399/249 |
| 6,195,156 | B1 | * | 2/2001 | Miyamoto et al. | 355/85 |
| 6,207,331 | B1 | * | 3/2001 | Akutsu et al. | 430/33 |
| 2004/0047646 | A1 | * | 3/2004 | Yon et al. | 399/93 |

FOREIGN PATENT DOCUMENTS

| | | | |
|---|---|---|---|
| EP | 0 399 186 | A2 | 11/1990 |
| EP | 0 692 800 | A2 | 1/1996 |
| JP | 52-70837 | | 6/1977 |
| JP | 1-306880 | A | 12/1989 |
| JP | 2-264280 | A | 10/1990 |
| JP | 5-11566 | | 1/1993 |
| JP | 8-81222 | A | 3/1996 |
| JP | 2005-234184 | A | 9/2005 |

* cited by examiner

*Primary Examiner*—David M Gray
*Assistant Examiner*—Billy J Lactaoen
(74) *Attorney, Agent, or Firm*—Nixon & Vanderhye, PC

(57) ABSTRACT

An image forming apparatus includes an ink image forming section, an irradiation section, an intermediate transfer section, a transfer section, a recoding medium feed section and a discharge section. When forming an image, the ink image forming section is irradiated with light by the irradiation section according to image information transmitted from an external device to form an electrostatic latent image, and the ink image forming section feeds an ink to the obtained electrostatic latent image to form an ink image. The ink image obtained is intermediately transferred to the intermediate transfer section, and then transferred to a recording medium by the transfer section. The recording medium is fed to the transfer section by the recording medium feed section, and after the ink image is transferred, the recording medium is discharged to an outside of the image forming apparatus by the discharge section.

12 Claims, 4 Drawing Sheets

IMAGE FORMING APPARATUS AND IMAGE FORMING METHOD WHICH UTILIZE A WET DEVELOPER SOLUTION

CROSS-REFERENCE TO RELATED APPLICATION

This application claims priority to Japanese Patent Application No. 2007-127313, which was filed on May 11, 2007, the contents of which are incorporated herein by reference in its entirety.

BACKGROUND OF THE TECHNOLOGY

1. Field of the Technology

The present technology relates to an image forming apparatus and an image forming method.

2. Description of the Related Art

Currently, image forming apparatuses such as a copying machine, a facsimile and a printer that employ an ink-jet method or an electrophotographic method become main stream.

In the ink-jet method an image is formed by spraying an ink toward a recording medium from an ink head of an ink cartridge by heat or vibration. The constitution of apparatus is simple, and size reduction is possible, but printing speed is slow.

Most of the electrophotographic methods use a so-called dry development method, and an image is formed using a powder toner. In recent years, with the demand of an image forming apparatus capable of forming a high definition and high quality image, particle size of a powder toner used in the dry development method becomes smaller. A toner having small particle size scatters out of an image forming apparatus, and contaminates the surrounding area. Furthermore, it is difficult to remove a toner that suspends and remains in an image forming apparatus after transfer treatment.

When the particle size of the toner is too small, where a person handling the toner inhales the toner suspended in an atmosphere, there is a possibility that the toner inhaled in the lungs is not metabolized, resulting in diseases such as pneumoconiosis. Thus, there is a limit in the dry development method using a toner having a small particle size.

In view of the above, a wet development method is being studied. In the wet development method, toner is used by being dispersed in a solvent. Therefore, the wet development method does not cause the problems generated in a dry development method, and it is easy to handle as a fine toner.

In the electrophotographic method, printing speed is fast, but a toner must be heated and melted in order to fix the toner to a recording medium. As a result, constitution of an apparatus equipped with a heating and melting section becomes large, and it is difficult to reduce the size of an apparatus. Furthermore, large energy is required to melt the toner.

A printer used in a printing field also uses a wet development method. However, in the conventional printers, it is required to prepare a plate of the original, and are not suitable for on-demand printing such as electrophotography.

In view of such a background, an image forming apparatus that has a small size, has fast printing speed, gives less influence to human body or environment, consumes less energy and additionally enables on-demand printing is desired.

The related art, for example, disclosed in Japanese Unexamined Patent Publication JP-A 05-011566 (1993), conducts image formation of electrophotographic method using a wet development method. In conducting the image formation, a latent image bearing member is charged and exposed to form an electrostatic latent image, the electrostatic latent image on the latent image bearing member is electrostatically transferred onto an intermediate transfer member having at least a dielectric layer and a conductive layer, the electrostatically transferred electrostatic latent image on the intermediate transfer member is visualized by wet development, and the visible image on the intermediate transfer member is non-electrostatically transferred to a final recording body by heating and pressurizing.

Such related art employs an electrophotographic method. Therefore, high voltage must be applied to a charging section which charges a latent image bearing member, and this makes an apparatus complicated and increase its size. For example, where a latent image bearing member is charged with a corona discharger or the like, large energy is consumed. Furthermore, the latent image bearing member deteriorates by high voltage, and there is a possibility to cause defective charging. When defective charging is caused, it is difficult to obtain a high precision image.

Furthermore, a toner must be heated and melted in order to fix the toner to a recording medium, and in such a case, large energy is consumed.

SUMMARY OF THE TECHNOLOGY

An object of the technology is to provide an image forming apparatus that consumes less energy, has a small size, and is capable of forming a high precision image, and an image forming method using the same.

The technology relates to an image forming apparatus that forms an image on a recording medium, comprising:

an ink image forming section that forms an ink image by depositing ink particles on an electrostatic latent image;

an intermediate transfer section to which the ink image formed in the ink image forming section is transferred;

a transfer section that transfers the ink image that has been transferred to the intermediate transfer section to the recording medium;

a recording medium feed section that feeds the recording medium to the transfer section; and a discharge section that discharges the recording medium having the ink image transferred thereto to an outside of the image forming apparatus;

wherein the ink image forming section comprises:

an ink storing section which stores therein an ink comprising an ink particle and a solvent in which the ink particle is dispersed;

an ink particle bearing section that has a photosensitive layer comprising a photocatalyst and is arranged so as to rotate in a state of being dipped in the ink; and an irradiation section in which the ink particle bearing section is irradiated with light to activate the photocatalyst, thereby charging the electrostatic latent image into reverse polarity to a charged polarity of the ink particles.

The image forming apparatus that forms an image on a recording medium comprises an ink image forming section that forms an ink image by depositing ink particles on an electrostatic latent image of the image; an intermediate transfer section to which the ink image formed in the ink forming section is transferred; a transfer section that transfers the ink image that has been transferred to the intermediate transfer section to the recording medium; a recording medium feed section that feeds the recording medium to the transfer section; and a discharge section that discharges the recording medium having the ink image transferred thereto to an outside of the image forming apparatus. The ink image forming section comprises an ink storing section that stores an ink comprising a solvent and ink particles dispersed therein; an ink particle bearing section that has a photosensitive layer comprising a photocatalyst is rotatably arranged in a state of being dipped in the ink; and an irradiation section in which the ink particle bearing section is irradiated with light to activate the photocatalyst, thereby charging the electrostatic latent image into reverse polarity to a charged polarity of the ink particles.

The ink particle bearing section has a photosensitive layer comprising a photocatalyst. Therefore, when the photocatalyst is irradiated with light by the irradiation section, electrons in valence band are excited. As a result, holes are formed in the valence band, electrons are formed in a conductive band, and a surface of the photosensitive layer in the ink particle bearing section is charged. Furthermore, an image is formed by a wet development method that forms an image by ink particles dispersed in a liquid ink. Therefore, even though charging intensity on the surface of the photosensitive layer in the ink particle bearing section is weak as compared with the case of using a dry development method, it is possible to deposit the ink particles on the surface of the ink particle bearing section. Consequently, because energy for charging is not necessary, consumption of energy can be suppressed. Because it is not necessary to provide a charging section, it is possible to reduce the size of an image forming apparatus. Furthermore, because the charging section is not necessary, deterioration of an ink particle bearing section is suppressed, and an image forming apparatus capable of forming a high precision image can be provided.

Because of using an ink, heating and melting as required in the case of using a toner is not required in transferring an ink image to a recording medium. This can suppress consumption of energy.

Furthermore, it is preferable that the ink particle bearing section is arranged so as to be in a state where the section is partially dipped in the ink.

An electrostatic latent image of the image is charged into reverse polarity to the charged polarity of the ink particle by the irradiation section in a region of the ink particle bearing section that is not dipped in the ink, and the region is then dipped in the ink to deposit the ink particle to the electrostatic latent image, thereby forming an ink image. Subsequently, the ink image moves to a region that is not dipped in the ink, and the ink image is transferred to the intermediate transfer section. In those ink image forming processes, for example, where the ink particle bearing section has a cylindrical shape, it is sufficient to only rotate, and this enables to minimize moving distance of the ink particle bearing section.

Furthermore, it is preferable that the image forming apparatus further comprises a counter electrode that is placed in the ink storing section, is arranged in a state of being dipped in the ink, and is arranged facing the ink particle bearing section; and an applying section that applies voltage having the same polarity as the charged polarity of the ink particle to the counter electrode.

Electric field is formed between the ink particle bearing section charged in reverse polarity to the polarity of the ink particle and the counter electrode charged in the same polarity as the polarity of the ink particle. The ink particle in the ink is charged in the same polarity as the polarity of the counter electrode and in reverse polarity to the polarity of the ink particle. Therefore, the ink particle is attracted to the ink particle bearing section. Ink flow that flows toward the ink particle bearing section from the counter electrode is formed, and the ink particle is ongoingly fed to the ink particle bearing section. This enables to form a stable ink image on the ink particle bearing section.

Furthermore, it is preferable that the counter electrode is formed into a shape of a spring.

Such a spring-shaped electrode enables to form strong electric field between the counter electrode and the ink particle bearing section. Furthermore, because the ink particle is ongoingly fed to the ink particle bearing section from a space of the spring-shaped electrode, it is possible to form a stable ink image on the ink particle bearing section.

Furthermore, it is preferable that an intermediate transfer position where the ink image formed on the ink particle bearing section is transferred to the intermediate transfer section is nearer a liquid level of the ink than a horizontal plane which passes through a center of the ink particle bearing section.

When the ink image is intermediately transferred to the intermediate transfer section promptly after the ink image formation, the ink particle that forms an ink image on the ink particle bearing section can be prevented from spilling out. This prevents the ink particle bearing section from being contaminated. Furthermore, formation of an ink image having high precision can result in formation of a high precision image.

Furthermore, it is preferable that the ink particle bearing section has an overcoat layer on an outside of the photosensitive layer.

The overcoat layer has strong resistance to a solvent contained in the ink, and therefore can suppress deterioration of the photosensitive layer.

Furthermore, it is preferable that the light is laser light.

Because writing speed by laser light is fast, high speed printing is possible. Furthermore, it is possible to form an electrostatic latent image of high resolution. Additionally, reduction in size of an apparatus can be attempted.

Furthermore, it is preferable that the image forming apparatus further comprises a cleaning section that cleans the ink particle bearing section.

When the ink particle remained on the ink particle bearing section after transferring the ink image to the intermediate transfer section is cleaned by the cleaning section, charging stability by the irradiation section is improved. Furthermore, because the residual ink particle can be recovered and reused, the amount of ink used can be suppressed.

Furthermore, it is preferable that the ink particle bearing section has a cylindrical shape.

When the ink particle bearing section has a cylindrical shape, rotating mechanism for rotating the ink particle bearing section is simplified, and it is possible to rotate the ink particle bearing section in a stable manner.

Furthermore, it is preferable that the ink particle bearing section has a belt shape.

A shape of the ink particle bearing section can be changed into various shapes such as elliptical shape. This enables to save space, and provides the spatial leeway in apparatus design.

Furthermore, it is preferable that the photocatalyst is titanium oxide.

The titanium oxide shows a remarkable photocatalyst active effect. Therefore, the titanium oxide is activated with less energy, and an electrostatic latent image can easily be formed on the ink particle bearing section.

Furthermore, it is preferable that the titanium oxide is rutile type titanium oxide.

The rutile type titanium oxide is physically and chemically stable as compared with anatase type titanium oxide or brookite type titanium oxide, and is therefore easy to use as a photocatalyst.

Furthermore, it is preferable that the titanium oxide has a volume average particle size of not less than from 10 nm nor more than 30 nm.

Where the volume average particle size of the titanium oxide exceeds 30 nm, charging property cannot be secured. Further, where the volume average particle size is less than 10 nm, it is difficult to produce such titanium oxide even by a baking method or a wet process, and production cost is increased.

Furthermore, it is preferable that the ink particle is transferred to the intermediate transfer section from the ink particle bearing section by applying voltage having reverse polarity to the charged polarity of the ink particle.

When the ink particle is transferred to the intermediate transfer section from the ink particle bearing section, the voltage having reverse polarity to the charged polarity of the ink particle is applied to the intermediate transfer section, and thereby intermediate transfer becomes easier, and the ink image is fed to the intermediate transfer section in a stable manner.

The technology further relates to an image forming method which forms an image on a recording medium, comprising:

storing an ink comprising an ink particle and a solvent in which the ink particle is dispersed, in an ink storing section;

irradiating with light an ink particle bearing section that has a photosensitive layer comprising a photocatalyst and is rotatably arranged in a state of being dipped in the ink, to activate the photocatalyst, thereby charging an electrostatic latent image of the image into reverse polarity to a charged polarity of the ink particle;

depositing the ink particle to the electrostatic latent image to form an ink image;

transferring the ink image formed on the ink particle bearing section to an intermediate transfer section;

transferring the ink image that has been transferred to the intermediate transfer section to the recording medium fed by a recording medium feed section; and discharging the recording medium having the ink image transferred thereto, to an outside of an image forming apparatus.

The image forming method which forms an image on a recording medium comprises storing an ink comprising an ink particle and a solvent in which the ink particle is dispersed, in an ink storing section; irradiating with light an ink particle bearing section that has a photosensitive layer comprising a photocatalyst and is rotatably arranged in a state of being dipped in the ink, to activate the photocatalyst, thereby charging an electrostatic latent image of the image into reverse polarity to the charged polarity of the ink particle; depositing the ink particle to the electrostatic latent image to form an ink image; transferring the ink image formed on the ink particle bearing section to an intermediate transfer section; transferring the ink image that has been transferred to the intermediate transfer section to the recording medium fed by a recording medium feed section; and discharging the recording medium having the ink image transferred thereto to an outside of an image forming apparatus.

The ink particle bearing section has a photosensitive layer comprising a photocatalyst. Therefore, when the photocatalyst is irradiated with light by the irradiation section, electrons of valence band are excited. As a result, holes are formed in the valence band, electrons are formed in a conductive band, and the surface of the photosensitive layer in the ink particle bearing section is charged. Furthermore, image is formed by a wet development method that forms an image by an ink particle dispersed in a liquid ink. Therefore, even though charging intensity on the surface of the photosensitive layer in the ink particle bearing section is weak as compared with the case of using a dry development method, it is possible to deposit the ink particle on the surface of the ink particle bearing section. Consequently, energy for charging is not necessary, and as a result, consumption of energy can be suppressed. Because it is not necessary to provide a charging section, it is possible to reduce the size of an image forming apparatus. Furthermore, because the charging section is not necessary, deterioration of an ink particle bearing section is suppressed, and an image forming method capable of forming a high precision image can be provided.

Because an ink is used, heating and melting are not necessary when transferring an ink image to a recording medium. This can suppress consumption of energy.

BRIEF DESCRIPTION OF THE DRAWINGS

Other and further objects, features, and advantages of the technology will be more explicit from the following detailed description taken with reference to the drawings wherein.

DETAILED DESCRIPTION

Figure 1:
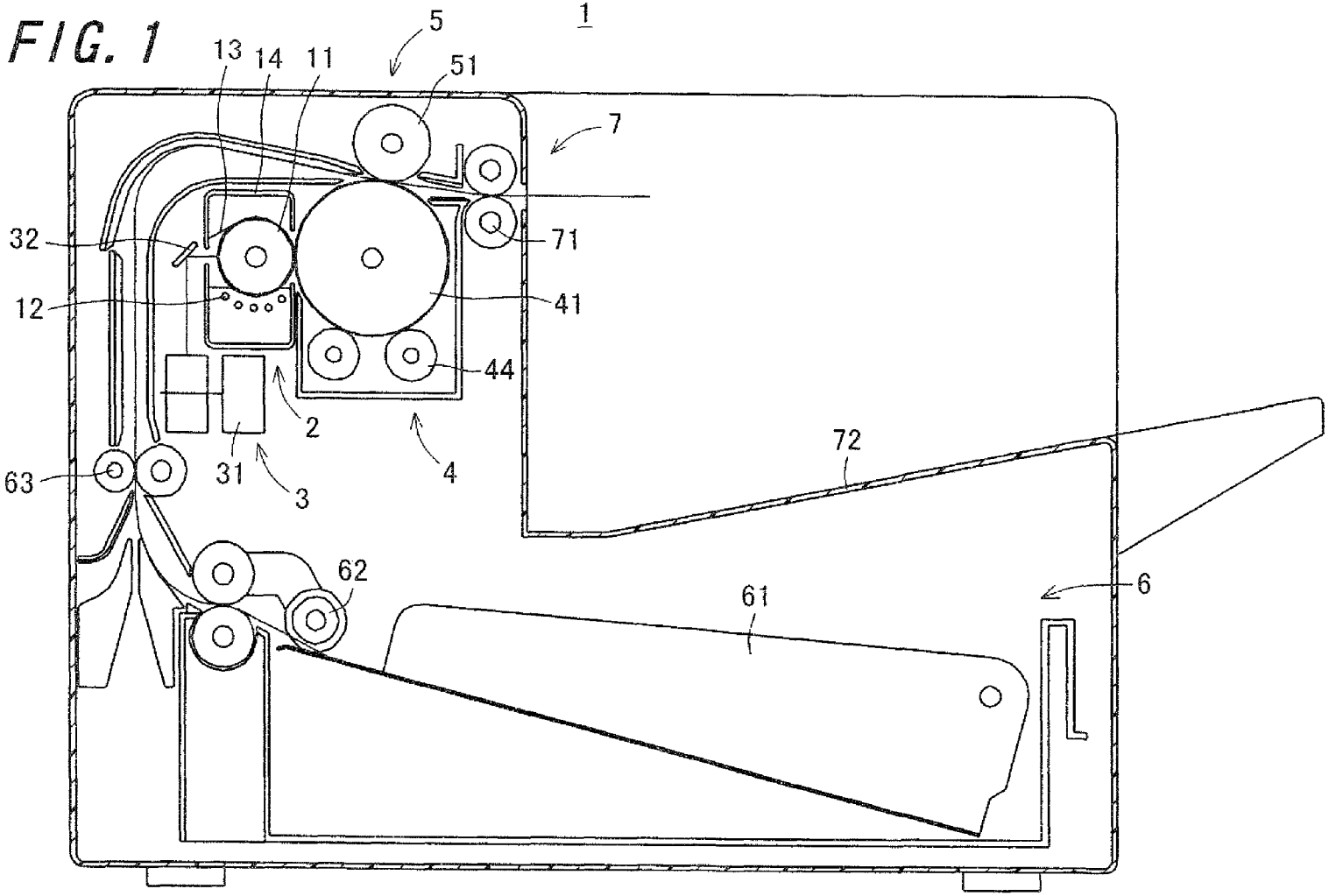
FIG. 1 is a sectional view schematically showing constitution of an image forming apparatus according to one embodiment of the technology.

Now referring to the drawings, preferred embodiments of the technology are described below.

FIG. 1 is a sectional view schematically showing constitution of an image forming apparatus 1 according to one embodiment of the technology. The image forming apparatus 1 forms a monochrome image on a recording medium according to image information transmitted from an external equipment (not shown). The external equipment can use electric and electronic instruments that can form or obtain image information and can be electrically connected to the image forming apparatus 1, and examples thereof include a computer, a digital camera, a television receiver, a video recorder, a DVD (Digital Versatile Disc) recorder, a blu-ray disc recorder, a facsimile apparatus and a mobile terminal unit.

The image forming apparatus 1 includes an ink image forming section 2, an irradiation section 3, an intermediate transfer section 4, a transfer section 5, a recording medium feed section 6 and a discharging section 7. When an image is formed, the ink image forming section 2 is irradiated with light by the irradiation section 3 according to image information transmitted from an external equipment to form an electrostatic latent image, and the ink image forming section 2 feeds an ink to the electrostatic latent image obtained to form an ink image. The ink image obtained is intermediately transferred to the intermediate transfer section 4, and then transferred to a recoding medium by the transfer section 5. The recording medium is fed to the transfer section 5 by the recording medium feed section 6, and after the ink image is transferred, the recording medium is discharged to an outside of the image forming apparatus 1 by the discharge section 7.

Figure 2A:
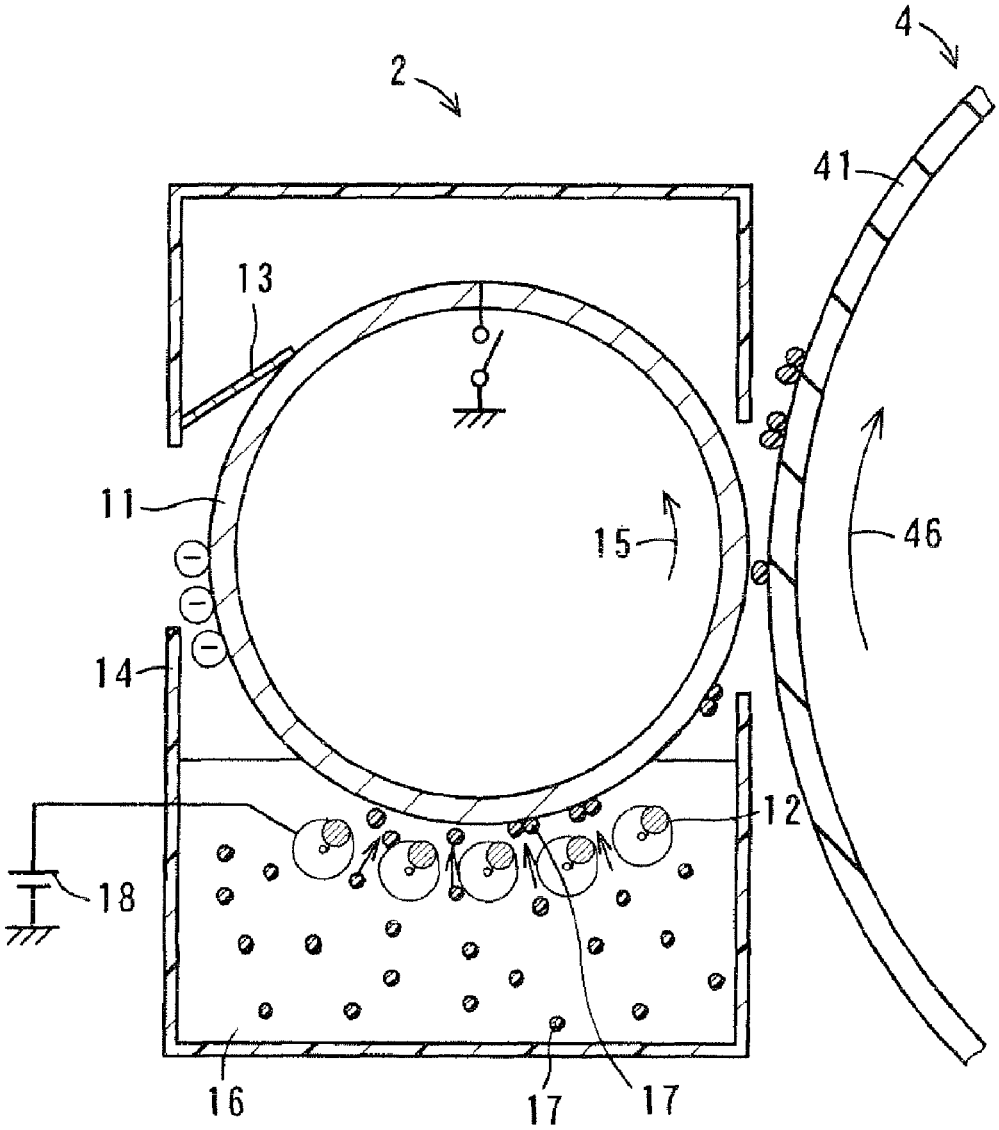
FIG. 2A is a simplified sectional view showing constitution of an ink image forming section and an intermediate transfer section.

FIG. 2A is a simplified sectional view showing constitution of the ink image forming section 2 and the intermediate transfer section 4. The ink image forming section 2 includes a photoreceptor drum 11, a counter electrode 12, a cleaning unit 13 and an ink storing section 14. The photoreceptor drum 11, the counter electrode 12 and the cleaning unit 13 are placed in the ink storing section 14. The photoreceptor drum 11 is rotatably supported by a drive mechanism (not shown) around an axis line, and is rotated in the direction of an arrow 15. An ink 16 containing an ink particle 17 for forming an image is stored in the ink storing section 14, and the photoreceptor drum 11 is arranged such that a part of the drum is dipped in the ink 16.

The counter electrode 12 is arranged in a state of being dipped in the ink 16, and voltage having the same polarity as a charged polarity of the ink particle 17 is applied to the counter electrode 12 by an applying section 18. An electrostatic latent image on the surface of the photoreceptor drum 11 is charged in reverse polarity to the charged polarity of the ink particle 17 by the irradiation section 3 described hereinafter.

Figure 3:
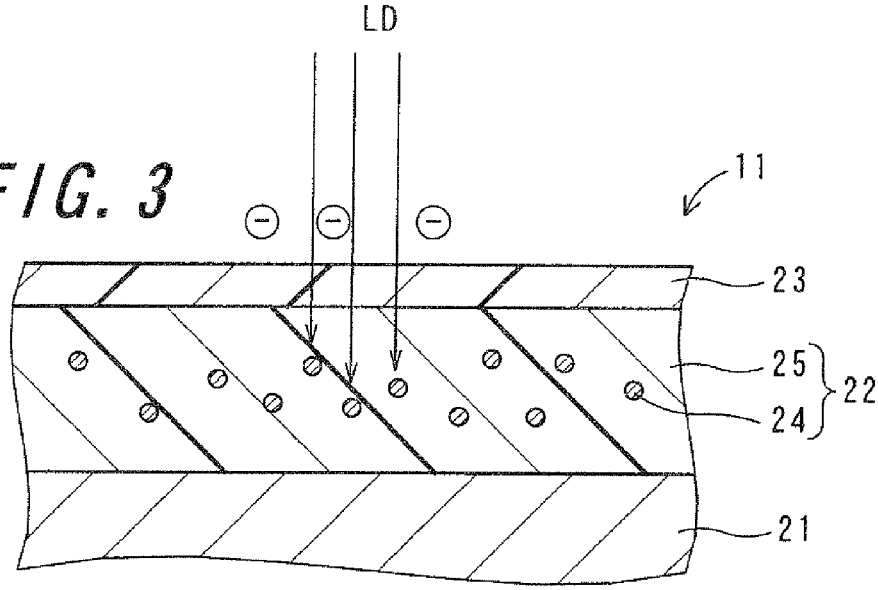
FIG. 3 is a sectional view showing a part of a photoreceptor drum.

FIG. 3 is a sectional view showing a part of the photoreceptor drum 11. The photoreceptor drum 11 includes a conductive substrate 21, a photosensitive layer 22 formed on the surface of the conductive substrate 21, and an overcoat layer on the outside of the photosensitive layer 22. The photosensitive layer 22 comprises a photocatalyst 24 and a binder 25.

The conductive substrate 21 can have various shapes, and examples of the shape include columnar shape, thin film sheet shape and belt shape, in addition to cylindrical shape like the photoreceptor drum 11. Among them, the cylindrical shape is preferable. When the conductive substrate 21 has the cylindrical shape, rotating mechanism for rotating the photoreceptor drum 11 is simplified, making it possible to rotate the drum in a stable manner. The conductive substrate 21 may have a belt shape. Because the belt shape can be deformed into various shapes such as elliptic shape, it is possible to reduce space, and spare space is generated in apparatus design. The conductive substrate 21 is formed of a conductive material.

When the conductive substrate 21 has the cylindrical shape, it is preferable that its radius is from 25 to 35 mm, and its length in a width direction is from 300 to 340 mm.

A conductive material of the conductive substrate 21 can be any materials that are generally used in this field, and examples thereof include metals such as aluminum, copper, brass, zinc, nickel, stainless steel, chromium, molybdenum, vanadium, indium, titanium, gold and platinum; alloys of at least two of those metals; conductive films comprising a film-like substrate such as a synthetic resin film, a metal film or a paper, having formed thereon a conductive layer comprising at least one of aluminum, an aluminum alloy, tin oxide, gold or indium oxide; and resin compositions containing a conductive particle or a conductive polymer. The film-like substrate used in the conductive film is preferably a synthetic resin film, and a polyester film is particularly preferable. Formation method of the conductive layer in the conductive film is preferably deposition, application or the like.

The photosensitive layer 22 contains the photocatalyst 24 and the binder 25 which holds the photocatalyst, and is provided on the conductive substrate 21. The overcoat layer 23 is provided on the photosensitive layer 22.

The photosensitive layer 22 is initialized prior to image formation. The initialization is conducted by homogenizing electrical conditions on a surface of the photosensitive layer 22. For example, the initialization is conducted by grounding the surface of the photosensitive layer 22. When the electrostatic latent image on the photosensitive layer 22 is irradiated with light in a state where the surface of the photosensitive layer 22 is not grounded after the initialization, potential difference is generated between an area irradiated with light and an area not irradiated with light. The mechanism of chemical change of such a behavior is not clarified, but it is considered to be due to that hole separation occurs when the photocatalyst 24 is excited by light irradiation.

As the photocatalyst 24, any optional material can be used so far as it has such an action. Specific examples of the material include $TiO_2$, $SnO_2$, $WO_3$, $V_2O_5$, $Nb_2O_5$, $Ta_2O_5$, $Fe_2O_3$, $SrTiO_3$, CdS, ZnS, PbS, CdSe and GaP. According to need, plural photocatalsyts may be mixed and used. Thus, the photocatalyst 24 can be any optional material. Among them, titanium oxide $TiO_2$ is particularly preferably used because of the high sensitivity and small influence to environment or human body. Remarkable photocatalyst activating effect is appeared in titanium oxide. Therefore, titanium oxide can be activated with less energy, and an electrostatic latent image can easily be formed on the ink particle bearing section.

As titanium oxide $TiO_2$, rutile type $TiO_2$, anatase type $TiO_2$, brookite type $TiO_2$ and the like are known, and rutile type $TiO_2$ is particularly preferable. The rutile $TiO_2$ is physically and chemically stable as compared with anatase type $TiO_2$ or brookite type $TiO_2$, and is therefore easy to use as a photocatalyst.

Furthermore, it is preferable that titanium oxide $TiO_2$ used as a photocatalyst has a volume average particle size measured with transmission electron microscope observation of not less than 10 nm nor more than 30 nm from the standpoint of increasing activity of a photocatalyst. Where the volume average particle size of titanium oxide exceeds 30 nm, charging property cannot be secured. On the other hand, where the volume average particle size is less than 10 nm, it is difficult to produce such a titanium oxide even by a baking method or a wet process, and production cost is increased.

When a binder material of the binder 25 which holds the photocatalyst 24 on the conductive substrate 21 is an inorganic material, examples of the inorganic material that can be used include a metal oxide, a carbide, and nitride ceramics. Examples of the metal oxide that can be used include $SiO_2$, $Al_2O_3$, $In_2O_3$, MgO, $ZrO_2$, $Y_2O_3$, $SnO_2$, $Cr_2O_3$ and $La_2O_3$. Examples of the carbide that can be used include SiC, WC and TiC. Examples of the nitride ceramics that can be used include $C_3N_4$, $Si_3N_4$, BN and TiN.

When the binder material is an organic material, examples of the organic material that can be used include a polycarbonate resin, a phenolic resin, a nylon resin, a silicon resin, a siloxane resin, an epoxy resin, a polyethylene resin, a polyester resin, a vinyl alcohol resin, a polyacrylate resin, a butyral resin, a polyvinyl acetal resin, a vinyl acetate resin, a diallyl phthalate resin, a polystyrene resin, a polysulfone resin, an acrylic resin, a polyphenylene oxide resin, an alkyd resin, a styrene-butadiene copolymer resin, a styrene-maleic anhydride copolymer resin, a urethane resin and other polymers.

Those binder materials can optionally be selected, and according to need, plurality of those binder materials can be mixed in any proportion and used. However, where an organic material is selected as the binder material of the photosensitive layer 22, the binder material in an area in which the photosensitive layer 22 is irradiated with light may induce chemical reaction. Even in such a case, where the same image is repeatedly obtained from the photosensitive layer 22 irradiated with light, the object of image formation can be achieved only if the light-irradiated area has the desired potential. However, where different image is formed each time as in a copying machine, the photosensitive layer 22 of a photoreceptor after transferring an ink image to an image recording medium should be restored. Therefore, where such use is intended, a material that is difficult to induce chemical change by the photocatalyst 24 is preferable as a binder material of the photosensitive layer 22. A metal oxide, a carbide and nitride ceramics are particularly preferable, and where those are used as a binder material, long-life of the photosensitive layer 22 is achieved even in the case of repeating initialization and image formation.

An undercoat layer may be provided between the conductive substrate 21 and the photosensitive layer 22. When the undercoat layer is provided, the advantages are obtained that scratches and asperity present on the surface of the conductive substrate 21 are covered with the undercoat layer, thereby smoothening the surface of the photosensitive layer 22; charging property of the photosensitive layer 22 in repeated use is prevented from being deteriorated; and charging property of the photosensitive layer 22 under low temperature and low moisture environment is improved.

Examples of the undercoat layer include resin layers comprising various resin materials, and an alumite layer. Examples of a resin material forming the resin layer include resins such as a polyethylene resin, a polypropylene resin, a polystyrene resin, an acrylic resin, a vinyl chloride resin, a vinyl acetate resin, a polyurethane resin, an epoxy resin, a polyester resin, a melamine resin, a polycarbonate resin, a polyester carbonate resin, a polysulfone resin, a phenoxy resin, a polyarylate resin, a silicone resin, a polyvinyl butyral resin and a polyamide resin; copolymer resins containing at least two repeating units constituting those resins; casein, gelatin, polyvinyl alcohol and ethyl cellulose.

The undercoat layer may contain particles of a metal oxide and the like. When those particles are contained, volume resistance value of the undercoat layer can be controlled, and incorporation of charges into the photosensitive layer 22 from the conductive substrate 21 can further be suppressed. Additionally, electric properties of a photographic photoreceptor can be maintained even when change in temperature, humidity and the like is generated. The metal oxide particles include, for example, particles of titanium oxide, aluminum oxide, aluminum hydroxide, zinc oxide and the like. Where particles of a metal oxide and the like are contained in the undercoat layer, for example, those particles are dispersed in a resin solution having those resins dissolved therein to prepare a coating liquid for undercoat layer formation, and the coating liquid can be applied to the conductive substrate 21 to form an undercoat layer.

The photoreceptor may be a laminate photoreceptor of three-layered structure having large durability, and the overcoat layer 23 which protects the photosensitive layer 22, as an uppermost layer. The overcoat layer 23 has strong resistance to a solvent contained in an ink, and therefore can suppress deterioration of the photosensitive layer.

A layer comprising a curing resin, an inorganic filler-containing resin, an inorganic oxide and the like is used as the overcoat layer 23. Examples of the resin used in the overcoat layer 23 include an acrylonitrile-butadiene-styrene resin, an acrylonitrile-chlorinated polyethylene-styrene resin, an olefin-vinyl monomer copolymer, a chlorinated polyether, an allyl resin, a phenolic resin, a polyacetal, a polyamide, a polyamideimide, a polyacrylate, a polyallyl sulfone, a polybutylene, a polybutylene terephthalate, a polycarbonate, a polyether sulfone, a polyethylene, a polyethylene terephthalate, a polyimide, an acrylic resin, a polymethyl bentene, a polypropylene, a polyphenylene oxide, a polysulfone, a polystyrene, an acrylonitrile-styrene resin, a butadiene-styrene copolymer, a polyurethane, a polyvinyl chloride, a polyvinylidene chloride and an epoxy resin.

Examples of a filler added to the overcoat layer 23 include titanium oxide, tin oxide, zinc oxide, zirconium oxide, indium oxide, silicon nitride, calcium oxide, barium sulfate, indium-tin oxide (ITO), silica, colloidal silica, alumina, carbon black, fluorine resin fine powder, polysiloxane resin fine powder and polymeric charge transport material fine powder. Those may be used alone or two or more thereof may be used in combination. Those fillers may be surface-treated with an inorganic material or an organic material from the reasons of improvement of dispersibility, modification of surface property, and the like. Examples of the filler having been subjected to water-repellent treatment among those surface treatments include fillers treated with a silane-coupling agent, fillers treated with a fluorine silane-coupling agent, fillers treated with a higher fatty acid, and fillers copolymerization-treated with a polymeric material. Examples of the filler treated with an inorganic material include fillers surface-treated with alumina, zirconia, tin oxide, silica or the like.

The photoreceptor drum 11 has the photosensitive layer 22 comprising the photocatalyst 24. Therefore, when the photocatalyst 24 is irradiated with light by the irradiation section 3, electrons of valence band are excited. As a result, holes are formed in the valence band, electrons are formed in a conductive band, and the surface of a photosensitive layer 22 in the photoreceptor drum 11 is charged. Furthermore, image is formed by a wet development method that forms an image by the ink particle 17 dispersed in the liquid ink 16. Therefore, even though charging intensity on the surface of the photosensitive layer 22 in the photoreceptor drum 11 is weak as compared with the case of using a dry development method, it is possible to deposit the ink particle 17 on the surface of the photoreceptor drum 11. Consequently, because energy for charging is not necessary, consumption of energy can be suppressed. Because it is not necessary to provide a charging section, it is possible to reduce the size of the image forming apparatus 1. Furthermore, because the charging section is not necessary, deterioration of the photoreceptor drum 11 is suppressed, and the image forming apparatus 11 capable of forming a high precision image can be provided.

Because the ink 16 is used, heating and melting as required in toner are not necessary when transferring an ink image to a recording medium. This can suppress consumption of energy.

The ink storing section 14 is a container-like member, and stores the ink 16 in its internal space. Furthermore, the ink storing section 14 stores a screw member such as a stirring blade and rotatably supports the same. The screw member such as a stirring blade agitates the ink 16 to generate ink flow.

When a part of the photoreceptor drum 11 is dipped in the ink 16, the ink particle 17 is deposited on an electrostatic latent image and an ink image is formed on the photoreceptor drum 11. In the formation of an ink image, the electrostatic latent image on the surface of the photoreceptor drum 11 is charged in reverse polarity to the charged potential of the ink particle 17. Therefore, the ink particle 17 in the vicinity of the photoreceptor drum 11 in the ink storing section 14 is smoothly fed to the electrostatic latent image and deposited thereon.

After an electrostatic latent image of an image is charged into reverse polarity to the charged polarity of the ink particle 17 by the irradiation section 3 in an area which is not dipped in an ink, the photoreceptor drum 11 is dipped in the ink 16 to deposit the ink particle 17 on the electrostatic latent image, thereby forming an ink image. Thereafter, the drum moves to a region which is not dipped in the ink 16, and the ink image is transferred to the intermediate transfer section 4. In those ink image formation processes, for example, where the photoreceptor drum 11 has a cylindrical shape, it is sufficient to only rotate the same, and it is possible to minimize the moving distance of the photoreceptor drum 11.

Figure 4:
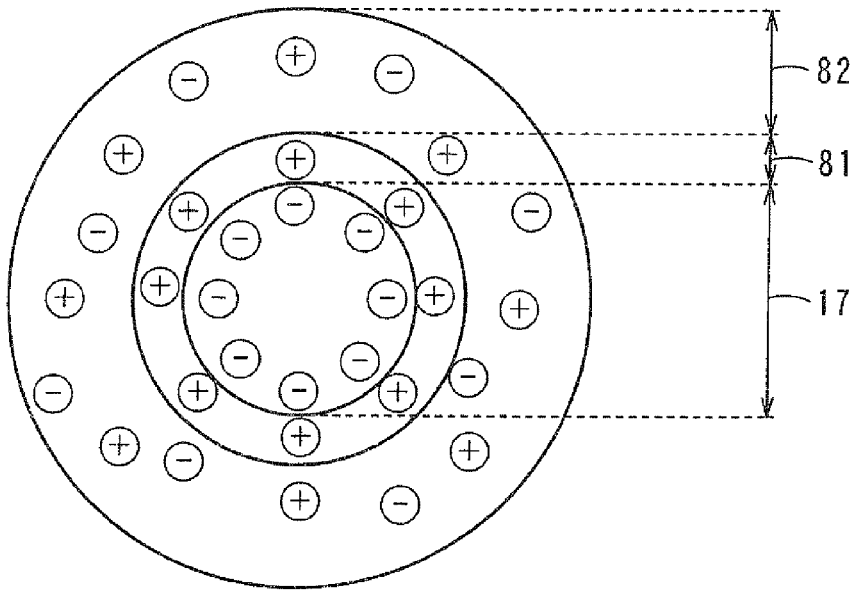
FIG. 4 is a schematic view for explaining charged polarity of an ink particle.

FIG. 4 is a schematic view for explaining the charged polarity of the ink particle 17. The periphery of the ink particle 17 is covered with a fixed layer 81, and the periphery of the fixed layer 81 is covered with a diffusion layer 82. In FIG. 4, the ink particle 17 dispersed in the ink is negatively charged. Ions having reverse polarity to the ink particle 17 gather in the ink on the surface of the ink particle 17 in order to try to electrically maintain neutrality. When such an ion cluster surrounds the surface of the ink particle 17 and gathers in a spherical shape, this results in that a layer comprising an ion having reverse polarity surrounds a surface layer of the ink particle 17. Such a layer is called an electric double layer or a fixed layer.

Distribution of ions in the ink is disordered due to thermal motion. Therefore, concentration of ions having charge (positive) opposite to that of the ion particle 17 is high near the surface of the ink particle 17, and is gradually decreased as the distance from the surface of the ink particle 17 increases. Concentration of ions having the same charge (negative) as that of the ink particle 17 shows the reverse tendency. In the region sufficiently apart from the ink particle 17, the charge of positive ion and the charge of negative ion get balanced out, and electrical neutrality is maintained. Thus, a layer actually appeared in a liquid is called a diffusion electric double layer or a diffusion layer.

The ink used is not particularly limited, and is a composition comprising a pigment, a water-dispersible resin and an organic solvent as the essential components, the remainder being water. Each component of the ink is described below.

(Pigment)

The conventional inorganic pigments and organic pigments can be used as the pigment. Specific examples of the inorganic pigment include black pigments that are carbon black such as furnace black, lamp black, acetylene black and channel black. When shown with a color index, specific examples of the organic pigment include:

blue pigments such as C.I. pigment blue 1, 2, 15, 15:1, 15:2, 15:3, 15:4, 15:6, 16, 17:1, 56, 60 and 63;

red pigments such as C.I. pigment red 1, 2, 3, 5, 7, 17, 22, 23, 31, 38, 48:2 (Ba), 48:2 (Ca), 48:3 (Sr), 48:4 (Mn), 49:1, 52:2, 53:1, 57:1, 60:1, 63:1, 63:2, 64:1, 81, 83, 88, 101, 104, 105, 106, 108, 112, 114, 122, 123, 146, 149, 166, 168, 170, 172, 177, 178, 179, 185, 190, 193, 209 and 219;

yellow pigments such as C.I. pigment yellow 1, 3, 12, 13, 14, 17, 24, 34, 35, 37, 42, 53, 55, 81, 83, 95, 97, 98, 100, 101, 104, 108, 109, 110, 117, 120, 128, 138 and 153;

black pigments such as C.I. pigment black 1 (aniline black);

C.I. pigment orange 1, 2, 5, 7, 13, 14, 15, 16, 34, 36 and 38;

C.I. pigment violet 1, 2, 19 and 32;

C.I. pigment green 1, 4 and 36; and

C.I. pigment brown 3, 5, 25 and 26.

The pigment may be a self-dispersible pigment having imparted thereto self-dispersibility in water by introducing a hydrophilic group into the surface of the pigment. The hydrophilic group is not particularly limited, and examples of the hydrophilic group include a carbonyl group, a carboxyl group, a hydroxyl group, a sulfone group and an ammonium group. At least one hydrophilic group is introduced into the surface of the pigment. The hydrophilic group introduced into the surface of the pigment may be bonded with an appropriate cation or anion to form a salt.

The conventional methods can be used for introduction of a hydrophilic functional group into the pigment surface. Examples of the introduction method include an oxidation treatment, a sulfonation treatment, a method of reacting an aromatic azo compound, an alkyl azo compound or the like with a pigment to introduce a hydrophilic functional group into a pigment surface using a phenyl group, an alkyl group or the like as a linking group, a treatment by a coupling agent such as a silane compound, a polymer grafting treatment, and a plasma treatment. At least two of those methods may be combined.

The commercially available self-dispersible pigment can also be used, and specific examples thereof include Cab-o-jet 200 and Cab-o-jet 300 (trade names, products of Cabot Corporation), and BONJET BLACK CW-1 and Microjet Black CW-1 (trade names, products of Orient Chemical Industries, Ltd.).

The pigment may be used alone or two or more thereof may be used in combination.

The content of the pigment is not particularly limited, and is appropriately selected from a wide range according to dispersion gravity and bulk density of the pigment itself, kind and content of a resin, ink properties required in an ink, color required in a recoded image to be obtained, concentration, and the like. The content of the pigment is preferably from 1 to 20% by weight based on the weight of the whole amount of an aqueous pigment ink. Where the content is considerably lower than 1% by weight, there is a possibility that image density of a recorded image is deficient. On the other hand, where the content greatly exceeds 20% by weight, an aqueous pigment ink becomes to show structural viscosity (non-Newtonian viscosity), flowability of an ink is decreased, and unevenness may be generated in a formed image.

(Water-Dispersible Resin)

A water-dispersible resin is used as, for example, a binder. When the blending amount of the water-dispersible resin to the self-dispersible pigment is selected from the specific range described above while maintaining the solid content which is the sum of the self-dispersible pigment and the water-dispersible resin in the specific range described above, an ink having excellent permeability (dryness) to a recording medium, and capable of forming a recorded image having high optical density without color oozing even when a recording medium is a plain paper is obtained.

Where a water-soluble resin is used in place of the water-dispersible resin, color oozing, deterioration of optical density, and the like cannot be avoided even when its content accords to the above-described specific content proportion.

The conventional resins can be used as the water-dispersible resin, and example thereof include a polyester resin, a styrene resin, a styrene-acrylic resin, a maleic acid resin, a polyvinyl alcohol resin, a polyvinyl pyrrolidone resin and a polyurethane resin. Of those, a polyester resin and a styrene-acrylic resin are preferable.

The water-dispersible resin may be emulsified according to the conventional method.

Furthermore, the commercially available water-dispersible resin emulsion may be used. Examples of the commercially available emulsion include VYLONAL (water-dispersible polyester resin emulsion, trade name, a product of Toyobo Co., Ltd.), JOHNCRYL (dispersible styrene-acrylic resin emulsion, trade name, a product of Johnson Polymer), MICROGEL (water-dispersible styrene-acrylic resin emulsion, trade name, a product of Nippon Paint Co., Ltd.), and BONKOTE (water-dispersible styrene-acrylic resin emulsion, trade name, a product of Dainippon Ink and Chemicals, Incorporated).

The water-dispersible resin can be used alone or two or more thereof may be used in combination.

(Organic Solvent)

The organic solvent is used to adjust storage stability of an ink, permeability to a recoding medium, and the like. The organic solvent is preferably a water-soluble organic solvent. The conventional solvents can be used as the water-soluble organic solvent, and examples thereof include:

polyhydric alcohols such as ethylene glycol, diethylene glycol, triethylene glycol, propylene glycol, dipropylene glycol, tripropylene glycol, polyethylene glycol, polypropylene glycol, 1,5-pentanediol, 1,2-alkane diol such as 1,2-hexanediol, 1,6-hexanediol, glycerin, 1,2,6-hexanetriol, 1,2,4-butanetriol, 1,2,3-butanetriol and petriol;

monohydric alcohols such as ethanol, isopropyl alcohol, butyl alcohol and benzyl alcohol;

glycol ethers such as triethylene glycol-n-butyl ether and tetraethylene glycol-n-butyl ether;

alkylene glycol alkyl ethers such as dipropylene glycol-n-propyl ether, diethylene glycol-n-butyl ether, triethylene glycol-n-butyl ether, tetraethylene glycol-n-butyl ether, propylene glycol-n-butyl ether and dipropylene glycol-n-butyl ether;

nitrogen-containing heterocyclic compounds such as N-methyl-2-pyrrolidone, N-hydroxyethyl-2-pyrrolidone, 2-pyrrolidone, 1,3-dimethylimidazolidinone and ∈-caprolactam;

amides such as formamide, N-methyl formaldehyde and N,N-dimethyl formamide;

amines such as monoethanolamine, diethanolamine, triethanolamine, monoethylamine, diethylamine and triethylamine;

sulfur-containing compounds such as dimethylsulfoxide, sulforane, thiodiethanol and thiodiglycerol;

propylene carbonate;

ethylene carbonate; and

γ-butyrolactone.

The organic solvent may be used alone or two or more thereof may be used in combination.

(Water)

The content of water is generally the remainder after using given amounts of the pigment, the water-dispersible resin and the organic solvent. However, considering storage stability of an ink, and the like, the content of water is preferably 20% by weight or more based on the total weight of the ink.

(Surfactant)

The ink may contain a surfactant in a range such that preferable properties of the ink are not impaired. The surfactant acts to adjust surface tension of an ink, assist dispersion of a pigment and assist permeation effect into a recording medium by an organic solvent.

The surfactant is preferably an anionic surfactant, a nonionic surfactant, and the like, and a nonionic surfactant is particularly preferable. Examples of the nonionic surfactant include:

a polyoxyethylene surfactant, a polyoxypropylene surfactant, a polyoxyethylene-propylene) type nonionic surfactant, acetylene glycol, an oxyethylene adduct of acetylene glycol, ethers such as a polyoxyethylene nonyl phenyl ether, polyoxyethylene alkyl allyl ether, a polyoxyethylene oleic acid, esters such as a polyoxyethylene oleate, a polyoxyethylene distearate, sorbitan laurate, sorbitan monostearate, sorbitan monooleate and a polyoxyethylene stearate; and fluorine-containing surfactants such as a fluorine alkyl ester and a perfluoroalkyl carboxylic acid salt. The surfactant may be used alone or two or more thereof may be used in combination. The content of the surfactant is not particularly limited. However, the content is generally from 0.01 to 3% by weight based on the total weight of the ink.

(Other Ink Component)

The ink can contain at least one of the conventional additives in a range that preferable properties of the ink are not impaired. Examples of the additive include a preservative and mildewproofing agent, a pH regulator, a chelate reagent and a rust preventive. Examples of the preservative and mildewproofing agent include Proxel (trade name), sodium dehydroacetate, sodium sorbinate, sodium 2-pyridinethiol-1-oxide, sodium benzoate and sodium pentachlorophenol. Optional materials so long as they do not adversely affect an ink blended and can adjust pH to 7 or more can be used as the pH regulator, and examples thereof include amines such as diethanolamine and triethanolamine; alkali metal hydroxides such as lithium hydroxide, sodium hydroxide and potassium hydroxide; ammonium hydroxide, quaternary ammonium hydroxide, quaternary phosphonium hydroxide, and alkali metal carbonates such as lithium carbonate, sodium carbonate and potassium carbonate. Examples of the chelate agent include sodium ethylenediamine tetraacetate, sodium nitrilotriacetate, sodium hydroxyethyl ethylenediamine triacetate, sodium diethylene triamine pentaacetate and sodium uramil diacetate. Examples of the rust preventive include acidic sulfite, sodium thiosulfate, ammon thiodiglycolate, diisopropylammonium nitrite, tetranitric acid pentaerythritol and dicyclohexylammonium nitrite.

The ink may further contain a water-soluble ultraviolet absorber, a water-soluble infrared absorber, a dissolution aid, an antioxidant, a defoamer, a viscosity regulator and a fungicide in a range that preferable properties of the ink are not impaired.

The ink can be produced by, for example, using given amounts of the self-dispersible pigment, the water-dispersible resin, the organic solvent, and according to need, an appropriate amounts of other additives, adding water to those to make the whole amount 100% by weight, and dispersing or mixing each component in water. The dispersion is conducted using the general disperser. The disperser includes, for example, a disper, a sand mill, a homogenizer, a ball mill, a bead mill, a paint shaker and an ultrasonic disperser. The mixing is conducted with a stirrer equipped with stirring blades, a high speed disperser, an emulsifier or the like.

Although the ink thus obtained can be used as it is, the ink may be subjected to filtration prior to the use. The filtration is conducted, for example, using a filter having a pore size of from 0.3 to 1.2 μm at ordinary pressure, under pressure or under reduced pressure.

To smoothly feed the ink particle 17 to an electrostatic latent image, the counter electrode 12 is provided in the ink storing section 14. The counter electrode 12 is arranged in a state of being dipped in the ink 16, and is arranged facing the photoreceptor drum 11. Voltage having the same polarity as the charged polarity of the ink particle 17 is applied to the counter electrode 12 by the applying section 18. Because the ink particle 17 is positively charged, positive voltage is applied to the counter electrode 12. The amount of ink fed to the electrostatic latent image can be controlled by changing the applied voltage value.

Electric field is formed between the photoreceptor drum 11 charged in reverse polarity to the polarity of the ink particle 17 and the counter electrode 12 charged in the same polarity as that of the ink particle 17. The ink particle 17 in the ink 16 is charged in the same polarity as that of the counter electrode 12 and in reverse polarity to the photoreceptor drum 11, and is therefore attracted to the photoreceptor drum 11. Ink flow forwarding to the photoreceptor drum 11 from the counter electrode 12 is formed, and the ink particle 17 is ongoingly fed to the photoreceptor drum 11. This enables a stable ink image to form on the photoreceptor drum 11.

Shape of the counter electrode 12 is preferably a spring shape. The spring-shaped electrode is a coil spring-shaped electrode, and is arranged parallel to an axial direction of the photoreceptor drum 11 at a position facing the photoreceptor drum 11 in a state of being dipped in the ink 16. Length at elongation of the spring-shaped electrode is from 300 to 340 mm that is the same degree of length in the axial direction of the photoreceptor drum 11. It is preferable that the spring-shaped electrode has an outer diameter of from 5 to 7 mm, and a line diameter of from 0.5 to 0.6 mm. Plural spring-shaped electrodes may be arranged with the same interval. The spring-shaped electrodes are arranged with the interval of from 1 to 2 mm such that the adjacent spring-shaped electrodes do not come in contact with each other. Where the spring-shaped electrodes come in contact with each other, those are short-circuited.

Material of the spring-shaped electrode is preferably a stainless steel (SUS). For example, SUS304WP spring material is preferably used. The spring-shaped electrode enables strong electric field to be formed between the electrode and the photoreceptor drum 11. Furthermore, the ink particle 17 is ongoingly fed to the photoreceptor drum 11 from the space of the spring-shaped electrode, and this enables to form a stable ink image on the photoreceptor drum 11.

The counter electrode 12 preferably has a grid shape. The grid-shaped electrode is a net-like electrode and is arranged parallel to an axial direction of the photoreceptor drum 11 at a position facing the photoreceptor drum 11 in a state of being dipped in the ink 16. The grid-shaped electrode is preferably curved matching to the periphery of the photoreceptor drum 11. The grid-shaped electrode has a length in a longitudinal direction of from 300 to 340 mm that is the same degree of the length in the axial direction of the photoreceptor drum 11. Length in a width direction is not particularly limited, but is a width such that the grid-shaped electrode is entirely dipped in the ink 16. The net preferably has an opening of from 0.5 to 2.0 mm.

Material of the grid-shaped electrode is preferably a stainless steel (SUS). For example, SUS304 is preferably used.

The spring-shaped electrode and the grid-shaped electrode are preferably arranged with an interval of from 0.8 to 1.2 mm from the photoreceptor drum 11. Where the interval is less than 0.8 mm, the electrode may come in contact with the photoreceptor drum 11, and on the other hand, where the interval exceeds 1.2 mm, sufficiently strong electric field cannot be obtained. The applied voltage is preferably from 100 to 400V.

Openings are formed at two mutually facing sides of the ink storing section 14, and a rotating axis of the photoreceptor drum 11 is rotatably supported to two mutually facing edges of the ink storing section 14. The photoreceptor drum 11 is irradiated with light from one opening by the irradiation section 3 described hereinafter to form an electrostatic latent image on the photoreceptor drum 11. An intermediate transfer drum 41 of the intermediate transfer section 4 described hereinafter is rotatably arranged at a position facing the periphery of the photoreceptor drum 11 through another opening. The ink image on the photoreceptor drum 11 is intermediately transferred to the intermediate transfer drum 41 at a pressure-contact portion between the periphery of the photoreceptor drum 11 and the periphery of the intermediate transfer drum 41.

Sealing processing is preferably applied to the opening in order to reduce the space between the opening and the photoreceptor drum 11 such that the ink 16 stored in the ink storing section 14 does not leak from the opening.

Figure 2B:
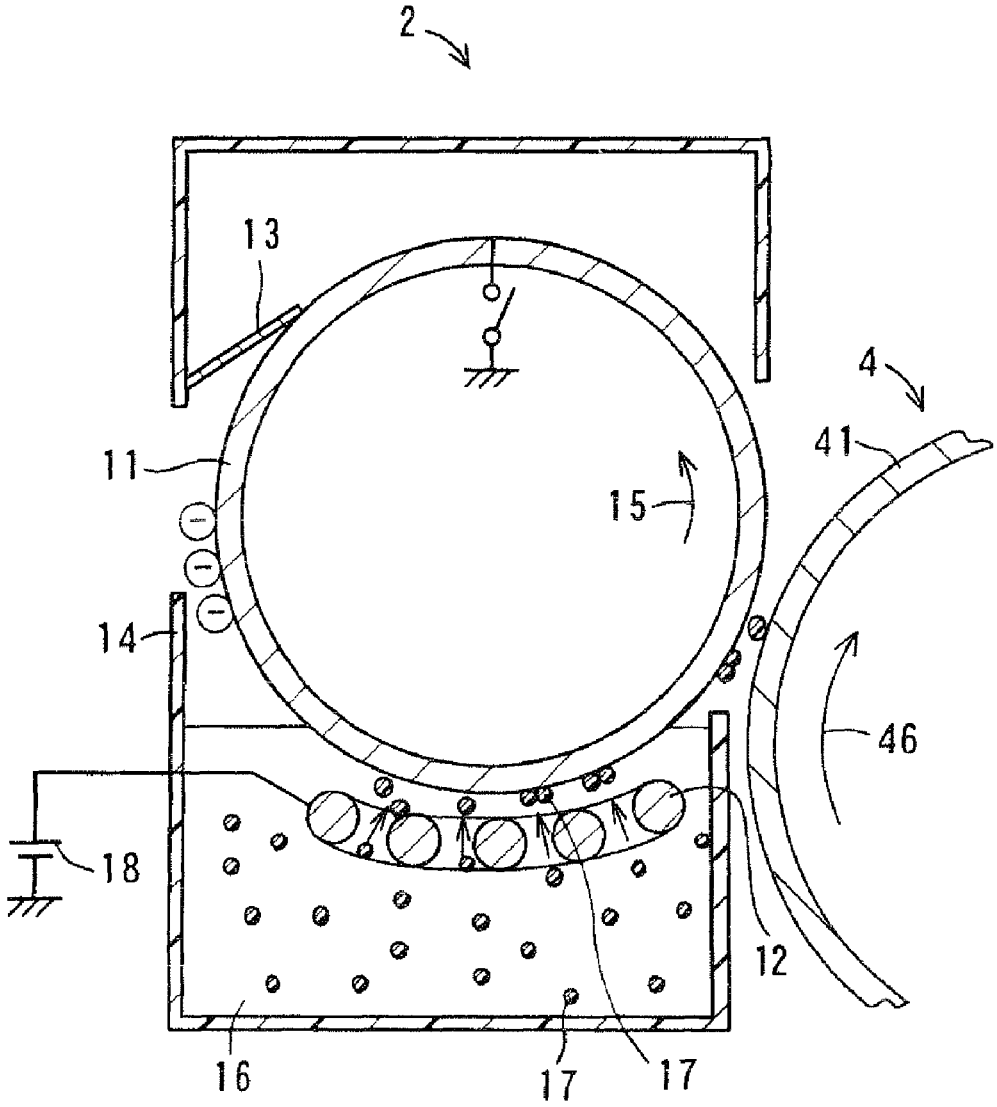
FIG. 2B is a simplified sectional view showing an alternate embodiment of an ink image forming section and an intermediate transfer section.

The intermediate transfer position where the ink image formed on the photoreceptor drum 11 is intermediately transferred to the intermediate transfer drum 41 preferably is nearer a liquid level side of the ink 16 than a horizontal plane which passes through the center of the photoreceptor drum 11. FIG. 2B illustrates this type of an arrangement. When after formation of the ink image, the ink image is intermediately transferred to the intermediate transfer drum 41 promptly, the ink particle 17 that forms an ink image on the photoreceptor drum 11 is prevented from spilling out, and as a result, the photoreceptor drum is prevented from being contaminated. Furthermore, when the ink image has high precision, it is possible to form a high precision image.

The cleaning unit 13 removes the ink particle remained on the surface of the photoreceptor drum 11 after intermediately transferring the ink image on the surface of the photoreceptor drum 11 to the intermediate transfer drum 41, and cleans the surface of the photoreceptor drum 11. A plate-like member such as a cleaning blade or a scraper is used in the cleaning unit 13. Although the cleaning unit 13 is provided, the technology is not limited to the embodiment, and the cleaning unit 13 may not be provided. When the ink particle 17 remained on the photoreceptor drum 11 is cleaned after intermediately transferring to the intermediate transfer drum 41, electrostatic stability by the irradiation section 3 is improved. Furthermore, the residual ink particle 17 can be recovered and reused, thereby suppressing the amount of the ink 16 used.

According to the ink image forming section 2, the surface of the photoreceptor drum 11 is irradiated with signal light according to image information from the irradiation section 3 to form an electrostatic latent image, the ink particle 17 in the ink 16 stored in the ink storing section 14 is fed to the electrostatic latent image to form an ink image, the ink image is intermediately transferred to the intermediate transfer section 4, and then the ink remained on the surface of the photoreceptor drum 11 is removed with the cleaning unit 13. A series of the ink image formation operation is repeatedly conducted.

The ink particle alone or the ink containing the ink particle can be replenished in the ink storing section 14 by an ink replenishing section (not shown). The remaining amount of the ink is detected by a sensor or the like, and is transmitted to the ink replenishing section.

In the irradiation section 3, light is emitted from a light source 31 and applied to the surface of the photoreceptor drum 11. Light is applied to light irradiation positions that are arranged in the order of the cleaning unit 13, the light irradiation position and the counter electrode 12 toward a downstream side in the rotating direction of the photoreceptor drum 11. Light emitted from the light source 31 is branched by a branching section 32 provided in the irradiation section 3, and then applied to the surface of the photoreceptor drum 11, and an electrostatic latent image is formed on the surface thereof. The irradiation section 3 can be a laser scanning unit equipped with, for example, a laser irradiation section as the light source 31, and plural reflection mirrors as the branching section 32. Other than this, a unit comprising an appropriate combination of an LED array, a liquid crystal shutter and a light source may be used. Writing speed by laser light is fast, and therefore high speed printing is possible. Furthermore, it is possible to form an electrostatic latent image of high resolution. Additionally, a size of the image forming apparatus 1 can be reduced.

A wavelength of laser light is preferably 380 nm or less where, for example, the photosensitive layer comprises titanium oxide. Titanium oxide absorbs a short wavelength of 380 nm or less, thereby inducing photocatalyst reaction. Where dye-sensitized titanium oxide is used, laser light having a longer wavelength can be used.

The intermediate transfer section 4 is arranged adjacent to the photoreceptor drum 11, and includes the intermediate transfer drum 41 and the intermediate transfer drum cleaning unit 44. The intermediate transfer drum 41 is a cylindrical drum arranged such that its periphery comes in contact with the periphery of the photoreceptor drum 11. The intermediate transfer drum 41 is rotatably arranged around its axis by a driving mechanism (not shown), and rotates in the direction of an arrow 46. When the intermediate transfer drum 41 passes through the photoreceptor drum 11 while coming in contact with the photoreceptor drum 11, intermediate transfer bias of reverse polarity to the charged polarity of the ink particle 17 on the surface of the photoreceptor drum 11 is applied to the intermediate transfer drum 41, and the ink image formed on the surface of the photoreceptor drum 11 is intermediately transferred onto the intermediate transfer drum 41.

A material of the surface of the intermediate transfer drum 41 is preferably a material that does not absorb water and on which ink particle is liable to deposit. For example, the material is preferably an ethylene propylene rubber (EPM and EPDM).

At the pressure-contact portion between the intermediate transfer drum 41 and the photoreceptor drum 11, line pressure of about 1 to 5 kg/cm is applied to the whole width of the photoreceptor drum 11. A light source (not shown) that applies intermediate transfer bias is connected to the intermediate transfer drum 41, and the intermediate transfer bias value is about −2,000 to 0 V. At the pressure-contact portion, the ink image on the surface of the photoreceptor drum 11 is intermediately transferred to the intermediate transfer drum 41.

The intermediate transfer bias value may be constant or variable. Where the intermediate transfer bias is varied, for example when the ink image is present at the pressure-contact portion, the intermediate transfer bias of about −2,000 to −1,000 V is applied. When the ink image is not present at the pressure-contact portion, that is, when a laser-written image is not present, it is preferable to apply the intermediate transfer bias of about −1,000 to 0 V that is smaller than that when transferring the ink image in the absolute value. When voltage of reverse polarity to the charged polarity of the ink particle 17 is applied to the intermediate transfer drum 41, intermediate transfer becomes easier, and the ink image is stably fed to the intermediate transfer drum 41.

The intermediate transfer drum cleaning unit 44 is provided so as to come in contact with the outer periphery of the intermediate transfer drum 41. The ink deposited on the intermediate transfer drum 41 by coming in contact with the photoreceptor drum 11 causes contamination of the back of a recording medium. Therefore, the intermediate transfer drum cleaning unit 44 removes and recovers ink particle on the surface of the intermediate transfer drum 41.

The transfer section 5 includes a transfer roller 51. The transfer roller 51 comes in pressure-contact with the intermediate transfer drum 41, and is arranged so as to be able to rotate around an axis line by a driving mechanism (not shown). At the pressure-contact portion (hereinafter sometimes referred to as "transfer nip portion) between the transfer roller 51 and the intermediate transfer drum 41, the ink image borne on the intermediate transfer drum 41 and conveyed is transferred to a recording medium sent from the recording medium feed section 6 described hereinafter. According to the transfer section 5, the ink image transferred to the intermediate transfer drum 41 from the photoreceptor drum 11 at the pressure-contact portion between the photoreceptor drum 11 and the intermediate transfer drum 41 is conveyed to the transfer nip portion by the rotating drive in the direction of the arrow 46 of the intermediate transfer drum 41, and transferred to the recording medium there.

The recording medium feed section 6 includes an automatic paper feed tray 61, a pick-up roller 62 and a carrier roller 63. The automatic paper feed tray 61 is arranged at the under side in the vertical direction of the image forming apparatus 1, and is a container-shaped member that stores a recording medium. The recording medium includes a plain paper, a color copying paper, a paper for overhead projector, and a postcard. Recording papers such as a plain paper and a color copying paper are classified into a standard paper, a smooth paper and a rough paper. The standard paper is mainly commercially available copy papers. The smooth paper is mainly coated papers. The rough paper is mainly regenerated papers. The pick-up roller 62 picks up recording media one by one stored in the automatic paper feed tray 61 and sends the same to a paper carrier passage S1. The carrier roller 63 is a pair of roller members provided so as to come in pressure-contact with each other, and sends the recording medium to a transfer nip section, synchronizing with that the ink image borne on the intermediate transfer drum 41 is sent to the transfer nip section. Although not shown, a manual paper feed tray may be provided. The manual paper feed tray is an apparatus that incorporates the recording medium into the image forming apparatus 1 by manual operation.

The discharge section 7 includes a discharge roller 71 and a discharge tray 72. The discharge roller 71 discharges the recording medium having an image transferred thereto to the discharge tray 72 provided at the upper side in the vertical direction of the image forming apparatus 1. The discharge tray 72 stores the recording medium to which an image has been transferred.

The recording medium can be conventionally used ones and examples thereof include plain paper, postcard paper, color copying paper, ink-jet printing paper, plastic sheets, plastic films and the like.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. An image forming apparatus that forms an image on a recording medium, comprising:

an ink image forming section that forms an ink image by depositing ink particles on an electrostatic latent image;

an intermediate transfer section to which the ink image formed in the ink image forming section is transferred;

a transfer section that transfers the ink image that has been transferred to the intermediate transfer section to the recording medium;

a recording medium feed section that feeds the recording medium to the transfer section; and a discharge section that discharges the recording medium having the ink image transferred thereto to an outside of the image forming apparatus;

wherein the ink image forming section comprises:

an ink storing section which stores therein an ink comprising ink particles charged with a first polarity dispersed in a solvent;

an ink particle bearing section that has a photosensitive layer comprising a photocatalyst and that is arranged so as to rotate while being at least partially immersed in the ink;

an irradiation section that irradiates the ink particle bearing section with light to activate the photocatalyst, thereby forming an electrostatic latent image on the ink particle bearing section that has a second polarity that is opposite to the first polarity;

a counter electrode that is immersed in the ink in the ink storing section and that is arranged facing the ink particle bearing section, wherein the counter electrode comprises a plurality of elongated spiral shaped electrodes that are arranged in the ink storing section in an array that faces a surface of the ink particle bearing section, wherein longitudinal axes of the plurality of elongated spiral shaped electrodes are arranged parallel to a longitudinal axis of the ink particle bearing section, wherein an external diameter of each of the plurality of spiral shaped electrodes is approximately 5-7 mm, and wherein a spacing between adjacent ones of the plurality of spiral shaped electrodes is approximately 1-2 mm; and an applying section that applies a voltage to the counter electrode having the first polarity, which is the same polarity as the charged ink particles.

2. The image forming apparatus of claim 1, wherein an intermediate transfer position where the ink image formed on the ink particle bearing section is transferred to the intermediate transfer section is nearer a liquid level of the ink than a horizontal plane which passes through a center of the ink particle bearing section.

3. The image forming apparatus of claim 1, wherein the ink particle bearing section has an overcoat layer on an outside of the photosensitive layer.

4. The image forming apparatus of claim 1, wherein the light is laser light.

5. The image forming apparatus of claim 1, further comprising a cleaning section that cleans the ink particle bearing section.

6. The image forming apparatus of claim 1, wherein the ink particle bearing section has a cylindrical shape.

7. The image forming apparatus of claim 1, wherein the photocatalyst is titanium oxide.

8. The image forming apparatus of claim 7, wherein the titanium oxide is rutile type titanium oxide.

9. The image forming apparatus of claim 7, wherein the titanium oxide has a volume average particle size of not less than 10 nm nor more than 30 nm.

10. The image forming apparatus of claim 1, wherein the ink particles are transferred to the intermediate transfer section from the ink particle bearing section by applying a voltage having the second polarity to the intermediate transfer section.

11. The image forming apparatus of claim 1, wherein a spacing between a surface of the ink particle bearing section and the at least one elongated spiral shaped electrode is approximately 0.8-1.2 mm.

12. The image forming apparatus of claim 1, wherein a spacing between a surface of the ink particle bearing section and the counter electrode is approximately 0.8-1.2 mm.

* * * * *